US007434799B2

(12) United States Patent
Mizuno

(10) Patent No.: US 7,434,799 B2
(45) Date of Patent: Oct. 14, 2008

(54) FILM SHEET FEEDING MECHANISM USING A FEEDING ARM HAVING A SUCKING UNIT AND CORRESPONDING MECHANISM AND THERMAL DEVELOPMENT RECORDING APPARATUS HAVING THE SAME

(75) Inventor: Koichi Mizuno, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/221,862

(22) Filed: Sep. 9, 2005

(65) Prior Publication Data

US 2006/0071395 A1 Apr. 6, 2006

(30) Foreign Application Priority Data

Sep. 17, 2004 (JP) ..... P. 2004-271611

(51) Int. Cl.
*B65H 3/46* (2006.01)

(52) U.S. Cl. ..... 271/106; 271/90; 271/103

(58) Field of Classification Search ..... 271/10.01, 271/11, 12, 90, 103, 106–107
See application file for complete search history.

(56) References Cited

U.S. PATENT DOCUMENTS 3,584,866 A * 6/1971 Ross et al. ..... 271/12
3,938,800 A * 2/1976 Wirz ..... 271/93
4,189,136 A * 2/1980 Robinette ..... 271/12
4,509,736 A * 4/1985 Stahl et al. ..... 271/11
4,516,763 A * 5/1985 Stahl et al. ..... 271/11
4,663,528 A * 5/1987 Fujiwara et al. ..... 250/581
4,905,978 A * 3/1990 Polic ..... 271/5
4,968,019 A * 11/1990 Tanabe et al. ..... 271/106
5,094,439 A * 3/1992 Renner et al. ..... 271/103
5,143,364 A * 9/1992 Kharzo et al. ..... 271/108
5,277,414 A * 1/1994 Binnen ..... 271/107
5,895,037 A * 4/1999 Baureis et al. ..... 271/92
5,991,593 A * 11/1999 Sugiyama ..... 399/388
6,576,390 B1 * 6/2003 Shimizu et al. ..... 430/207

FOREIGN PATENT DOCUMENTS

JP 2004-148662 A 5/2004

* cited by examiner

*Primary Examiner*—Patrick H Mackey
*Assistant Examiner*—Gerald W McClain
(74) *Attorney, Agent, or Firm*—Sughrue Mion, PLLC

(57) ABSTRACT

A film sheet feeding mechanism which can be reduced in size, and which can stably conduct a feeding operation, and a thermal development recording apparatus having such a mechanism are provided. A film sheet feeding mechanism that, from a tray on which plural film sheets are stacked, takes out one by one a uppermost film sheet, and that feeds the film sheet toward a downstream side in a direction of transporting the film sheet, includes: a feeding arm having film sucking unit for taking out the film sheet in the tray; arm moving unit for, while supporting the feeding arm, moving the feeding arm between a film taking out position of the tray and a film supplying position on the downstream side in the transportation direction; and a lifting and lowering amplification mechanism which is disposed in the feeding arm, and which lifts and lowers the film sucking unit.

13 Claims, 15 Drawing Sheets

FILM SHEET FEEDING MECHANISM USING A FEEDING ARM HAVING A SUCKING UNIT AND CORRESPONDING MECHANISM AND THERMAL DEVELOPMENT RECORDING APPARATUS HAVING THE SAME

This application is based on Japanese Patent application JP 2004-271611, filed Sep. 17, 2004, the entire content of which is hereby incorporated by reference. This claim for priority benefit is being filed concurrently with the filing of this application.

BACKGROUND OF THE INVENTION

1. Technical Field of the Invention

The present invention relates to a film sheet feeding mechanism which is used in taking out a film sheet, also to a thermal development recording apparatus having the mechanism.

2. Description of the Related Art

As an example of a related art thermal development recording apparatus, known is a thermal development recording apparatus which comprises: an exposing section that exposes a thermal development recording material configured by a thermal development photosensitive material or a photosensitive heatsensitive recording material, to form a latent image; and a thermal developing section that heats the thermal development recording material having thereon the latent image to conduct thermal development (for example, see JP-A-2004-148662 (hereafter "JPA'662)).

The thermal development recording apparatus disclosed in JPA'662 has a configuration in which, as shown in FIG. 15, a film sheet feeding mechanism 504 that takes out one by one film sheets 502 stacked in a tray 500 straddles the film sheets 502 in a width direction and is supported by both upper side portions of the tray 500. Therefore, a supporting member which supports the film sheet feeding mechanism 504 is placed above the tray 500. In the film sheet feeding mechanism 504, a sucking member 506 which sucks each of the film sheets 502 is disposed. Therefore, the film sheet feeding mechanism 504 comprising the sucking member 506 must be lifted and moved by a stroke H in the height direction which is sufficient to cross over a sidewall of the tray 500, and a stroke L in the length direction which extends to a film transportation side. Consequently, there is a disadvantage that the whole height of a film loading section is large, and the total height of the apparatus is increased. Usually, one apparatus has a plurality of loading sections, and hence the increase of the height appears remarkable.

When the number of the film sheets 502 to be set in the tray 500 is increased, also the height of the sidewall of the tray 500 is correspondingly increased. As a result, also the vertical stroke of the sucking member 506 is increased, and the total stroke is further lengthened. In the same manner as described above, a larger space is required for the loading section. This impedes the miniaturization of the whole apparatus. When the total stroke is lengthened, the operation of the mechanism becomes unstable, and the operation speed is reduced.

SUMMARY OF THE INVENTION

The invention has been conducted under the above-mentioned circumstances. It is an object of the invention to provide a film sheet feeding mechanism which can be reduced in size, and which can stably conduct a feeding operation, and a thermal development recording apparatus having such a mechanism.

The object of the invention can be attained by the following configurations.

(1). A film sheet feeding mechanism for taking out one by one an uppermost film sheet from a tray on which plural film sheets in a cut-sheet state are stacked, and feeding the film sheet toward a downstream side in a direction of transporting the film sheet, wherein the mechanism comprises:

a feeding arm having film sucking unit for taking out the film sheet in the tray;

arm moving unit for, while supporting the feeding arm, moving the feeding arm between a film taking out position of the tray and a film supplying position on the downstream side in the transportation direction; and a lifting and lowering amplification mechanism which is disposed in the feeding arm, and which lifts and lowers the film sucking unit.

In the thus configured film sheet feeding mechanism, when the feeding arm is moved by the arm moving unit between the film taking out position of the tray and the film supplying position on the downstream side in the transportation direction, the lifting/lowering operation of the film sucking unit is magnified at the film taking out position by the lifting and lowering amplification mechanism. According to the configuration, in a state where the feeding arm is at the film taking out position, the film sucking unit is moved as a result of the magnified vertical operation, and hence the stroke of the feeding arm can be shortened as compared with the related art one. The lifting and lowering amplification mechanism can be placed inside the tray. Therefore, the film sheet feeding mechanism can be reduced in size by applying a low-profile structure using a small-sized unit configuration.

(2). The film sheet feeding mechanism according to (1), wherein the arm moving unit comprises side plates on sides of both ends of the feeding arm, each of the side plates having guide holes which are formed along a movement path of the feeding arm, and the lifting and lowering amplification mechanism has guide pins which are inserted into the guide holes, and lifts and lowers the film sucking unit via a link mechanism in cooperation with an operation of moving the guide pins along the guide holes.

In the thus configured film sheet feeding mechanism, the guide pins are moved along the guide holes of the arm moving unit, thereby causing the lifting and lowering amplification mechanism to lift and lower the film sucking unit via the link mechanism. Therefore, the lifting/lowering operation is enabled by a simple configuration without additionally disposing a driving source for lifting and lowering the film sucking unit.

(3). The film sheet feeding mechanism according to (2), wherein the lifting and lowering amplification mechanism comprises: two driven cam follower shafts which follow the movements of the guide pins along the guide holes; and a link mechanism which lifts and lowers the film sucking unit by means of the movements of the cam follower shafts, the arm moving unit comprises two cam grooves in each of the side plates, the cam grooves housing and guiding cam followers of the two driven cam follower shafts, and as the feeding arm is further lowered, an amount of change in a distance between the two cam grooves of each of the side plates is more increased, and a lifting and lowering distance of the film sucking unit is more increased by the link mechanism.

In the thus configured film sheet feeding mechanism, when the guide pins are moved along the guide holes of the arm moving unit, the driven cam follower shafts of the lifting and lowering amplification mechanism are housed in the cam grooves of the arm moving unit, respectively. As the feeding arm is further lowered, the distance between the driven cam follower shafts is more changed in accordance with the amount of change in distance between the cam grooves, and the lifting/lowering distance of the film sucking unit is magnified by the link mechanism. Namely, the distance between the driven cam follower shafts can be increased or decreased by increasing or decreasing the distance between the cam grooves. With using this distance change, the lifting/lowering distance of the film sucking unit can be increased by the link mechanism.

(4). The film sheet feeding mechanism according to (3), wherein, in a part of the link mechanism, meshing of sector gears is interposed for a whole stroke of the lifting and lowering operation.

In the thus configured film sheet feeding mechanism, during the stroke of lifting and lowering the film sucking unit via the link mechanism, the coupling of the guide pins and the driven cam follower shafts is realized via the meshing of the sector gears. Consequently, there is no deviation in rotation between the guide pins and the driven cam follower shafts, and the film sucking unit can be moved in parallel in a stabilized posture.

(5). The film sheet feeding mechanism according to (3) or (4), wherein a tension spring which maintains the driven cam follower shafts to a predetermined initial position is wound around the guide pins.

In the thus configured film sheet feeding mechanism, the guide pins are urged by the tension spring, and hence the driven cam follower shafts are held to the predetermined initial position by an elastic repulsive force accumulated in the tension spring. Since the tension spring is simply wound around the guide pins, the tension spring does not protrude to the outside, and the holding forces to the guide pins can be uniformly applied.

(6). The film sheet feeding mechanism according to any one of (3) to (5), wherein link components constituting the link mechanism are in contact with each other via contacting faces of counter link components connected to the link components in vicinities of a fulcrum and a point of application.

In the thus configured film sheet feeding mechanism, each of the link components constituting the link mechanism is connected to another component via the contact face, and a large bending moment which is produced when the film sucking unit conducts the lifting/lowering operation is dispersively received by the contact faces. Therefore, the components can be thinned, and the thinned components can contribute to the size reduction.

(7). A thermal development recording apparatus comprising at least:

an exposing section that exposes a thermal development recording material configured by one of a thermal development photosensitive material and a photosensitive heatsensitive recording material, to form a latent image; and a thermal developing section that heats the thermal development recording material having thereon the latent image to conduct thermal development, wherein a mechanism that supplies the thermal development recording material to the exposing section is a film sheet feeding mechanism according to any one of (1) to (6).

In the thus configured thermal development recording apparatus, the film sheet feeding mechanism is reduced in size, and the apparatus can be miniaturized. During a process of supplying a film sheet toward the exposing section, the feeding arm of the film sheet feeding mechanism enables a short movement stroke, and a stabilized feeding operation. Therefore, a high-speed stabilized operation of feeding film sheets can be conducted.

According to the film sheet feeding mechanism of one embodiment of the invention, the height of the film sheet feeding mechanism can be suppressed to a small value, and the stroke can be shortened, so that a stabilized operation can be conducted.

The thermal development recording apparatus of one embodiment of the invention comprises the above-mentioned film sheet feeding mechanism. Therefore, the whole thermal development recording apparatus can be reduced in size, and the operation is stabilized.

DETAILED DESCRIPTION OF THE INVENTION

Hereinafter, a preferred embodiment of the film sheet feeding mechanism of the invention and the thermal development recording apparatus comprising the mechanism will be described in detail with reference to the accompany drawings.

Figure 1:
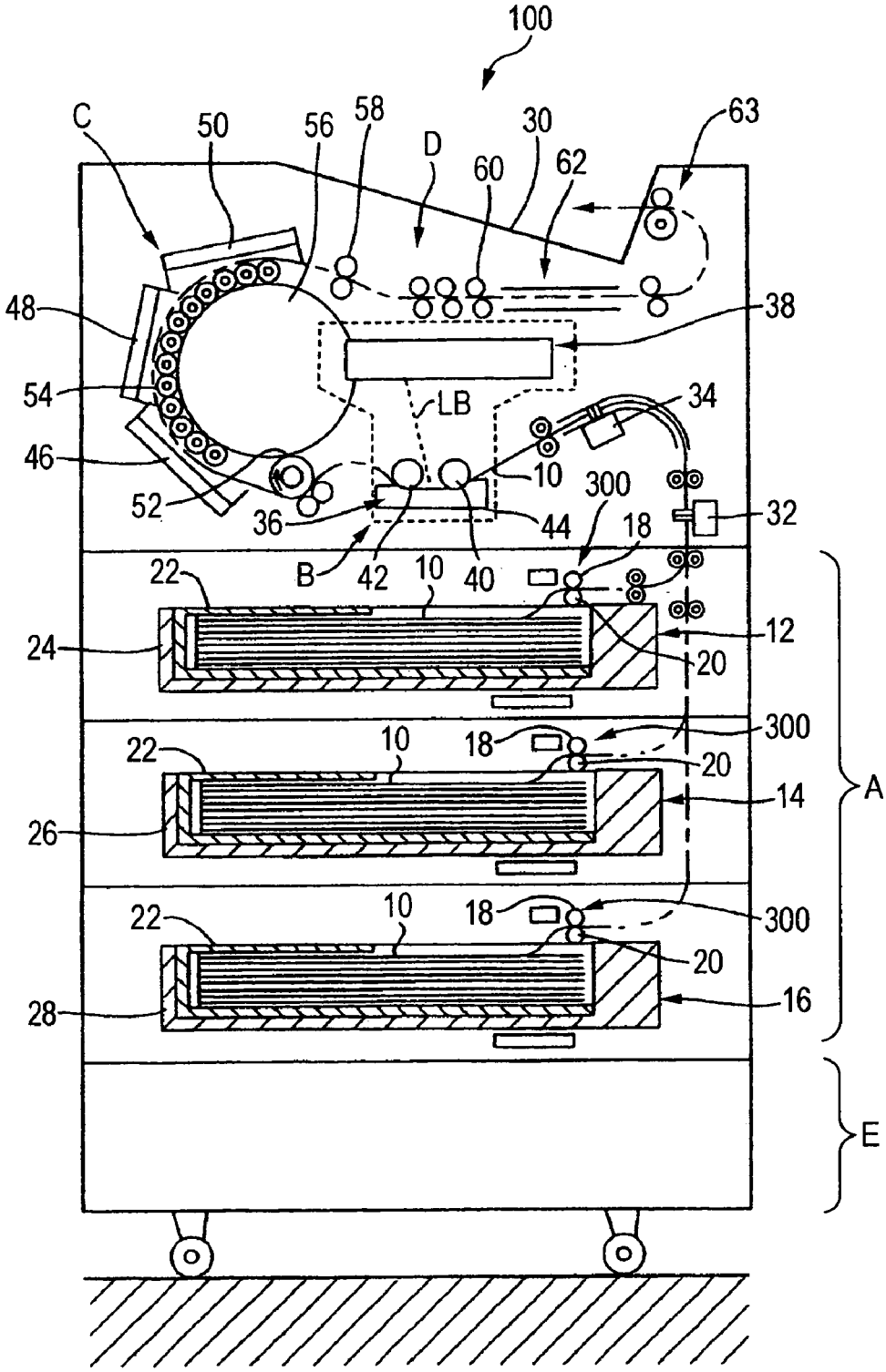
FIG. 1 is a diagram of the whole configuration of a thermal development recording apparatus showing an embodiment of the film sheet feeding mechanism of the invention and the thermal development recording apparatus comprising the mechanism.

FIG. 1 is a diagram of the whole configuration of a thermal development recording apparatus showing an embodiment of the film sheet feeding mechanism of the invention and the thermal development recording apparatus comprising the mechanism.

First, the whole configuration of the thermal development recording apparatus will be described.

As shown in FIG. 1, the thermal development recording apparatus 100 in which the film sheet feeding mechanism 300 that is an embodiment of the invention is used comprises a thermal development recording material supplying section A, an image exposing section B, a thermal developing section C, and a cooling section D in the sequence in the direction of transporting film sheets 10 which are thermal development recording materials. The apparatus also comprises: transporting means, disposed in main portions between the sections, for transporting the film sheets 10; and a power supplying/controlling section E which drives and controls the sections.

The thermal development recording apparatus 100 has a configuration in which the power supplying/controlling section E is placed in the lowermost stage, the thermal development recording material supplying section A is placed in an upper stage, and the image exposing section B, the thermal developing section C, and the cooling section D are placed in a further upper stage. The image exposing section B and the thermal developing section C are juxtaposed.

As the film sheets 10, a thermal development photosensitive material, a photo/heat-sensitive recording material, or the like may be used. A thermal development photosensitive material is a recording material in which an image is recorded (exposed) by a light beam (e.g., a laser beam), and then thermal development is applied to develop a color. A photosensitive heatsensitive recording material is a recording material in which an image is recorded by a light beam, and then thermal development is applied to develop a color, or a heat mode (heat) of a laser beam is applied to record an image and at the same time develop a color, and thereafter the image is fixed by light illumination.

The thermal development recording material supplying section A takes out one by one the film sheets 10 and supplies them to the image exposing section B located in the downstream side in the direction of transporting the film sheets 10. The section includes: three loading portions 12, 14, 16; film sheet feeding mechanisms 300, 300, 300 which are placed in the loading portions 12, 14, 16, respectively; lower rollers 20, 20, 20 which are opposed to and paired with upper rollers 18, 18, 18 disposed in the film sheet feeding mechanisms 300, respectively; and transportation rollers and transportation guides which are not shown. In the loading portions 12, 14, 16 having a three-stage structure, film loading magazines 22, 22, 22 in which the film sheets 10, 10, 10 having different sizes such as B4 size and a HANSETSU size are accommodated are housed in trays 24, 26, 28 which are magazine receivers, so that the sizes and orientations of the film sheets loaded in the stages can be selectively used.

The film sheets 10 are previously processed in cut sheets, and usually formed as laminated bodies (bundles) in the unit of a predetermined number of sheets such as about 150 sheets. The bundles are placed in the film loading magazines 22, 22, 22, respectively. The magazines are loaded into the stages of the thermal development recording material supplying section A, respectively.

The image exposing section B scans and exposes the film sheet 10 transported from the thermal development recording material supplying section A, with a light beam LB in a main scanning direction, and transports the sheet in a sub-scanning direction (i.e., the transportation direction) which is substantially perpendicular to the main scanning direction, thereby recording a desired image on the film sheet 10 to form a latent image.

The thermal developing section C raises the temperature of the scanned and exposed film sheet 10 while transporting the sheet, to conduct thermal development. Then, the thermal development recording material after the developing process is cooled in the cooling section D, and discharged to a discharge tray 30.

Width-aligning mechanisms 32, 34 are disposed in a transportation path between the thermal development recording material supplying section A and the image exposing section B, to supply the film sheets 10 transported from the thermal development recording material supplying section A, to the image exposing section B in a state where the ends in the width direction are aligned with each other.

Next, the image exposing section B will be described specifically.

The image exposing section B comprises: a sub-scanning transporting portion (sub-scanning means) 36 which exposes the film sheet 10 by light beam scanning exposure, and which has a flap preventing mechanism that transports the thermal development recording material while preventing flapping of the material with respect to the transportation surface; and a scanning exposing portion (laser irradiating means) 38. The scanning exposing portion 38 scans a laser beam (main scanning) while controlling the laser output in accordance with image data which are separately prepared. At this time, the film sheet 10 is moved in the sub-scanning direction by the sub-scanning transporting portion 36.

The sub-scanning transporting portion 36 comprises: two driving rollers 40, 42 the axes of which are substantially parallel to a main scanning line of the irradiated laser beam with being placed on both the sides of the main scanning line; and a guide plate 44 which is opposed to the driving rollers 40, 42, and which supports the film sheet 10. The guide plate 44 bends the film sheet 10 inserted between the driving rollers 40, 42, outside the juxtaposed driving rollers and along parts of the peripheral faces of the driving rollers, so that the driving rollers butt against the film sheet 10 to receive an elastic repulsive force due to the bending of the film sheet.

This bending causes the elastic repulsive force to be generated in the film sheet 10 itself. Because of the elastic repulsive force, a predetermined friction force is generated between the film sheet 10 and the driving rollers 40, 42, and a transportation driving force is surely transmitted from the driving rollers 40, 42 to the film sheet 10, so that the film sheet 10 is transported. Therefore, flapping of the film sheet 10 with respect to the transportation surface, i.e., vertical flapping is surely suppressed. The laser beam irradiates the film sheet 10 positioned between the driving rollers, thereby enabling superior recording to be conducted without causing misalignment of the exposure position. The driving rollers 40, 42 receive a driving force of driving means such as a motor which is not shown, vie transmitting means such as a gear or a belt, and rotate in a clockwise direction in FIG. 1.

Next, the thermal developing section C will be described.

The thermal developing section C heats a heating-process development recording material of the type in which a heating process is to be applied, and has a configuration in which a plurality of plate heaters 46, 48, 50 arranged in the transportation direction of the thermal development recording material are curved, and placed as a series of arcs.

Namely, the thermal developing section C including the plate heaters 46, 48, 50 is configured in the following manner. As illustrated, a concave face is formed in each of the plate heaters, and the film sheet 10 is slid over the concave face of the plate heater while being in contact therewith, whereby the film sheet is relatively moved. As means for transporting the film sheet 10, a supplying roller 52, and plural pressing rollers 54 which function also for transferring heat from the plate heaters to the film sheet 10 are disposed.

The pressing rollers 54 mesh with a gear 56 to be drivenly rotated by rotation of the gear 56. As the pressing rollers 54, metal rollers, resin rollers, rubber rollers, or the like can be used. According to the configuration, the film sheet 10 is transported while being pressed against the plate heaters 46, 48, 50. Therefore, the film sheet 10 is prevented from buckling. The curved plate heaters are a mere example. Other heating means may be configured by using a flat plate heater, a heating drum, or the like.

At the end of the transportation path for the film sheet 10 in the thermal developing section C, a discharge roller 58 for transporting the film sheet 10 is disposed. The film sheet 10 transported from the thermal developing section C is cooled by the cooling section D while preventing the film sheet from being wrinkled and curled. The film sheet 10 discharged from the cooling section D is guided into a guide plate 62 by cooling roller pairs 60 disposed in a middle of the transportation path, and further discharged from the discharging roller pair 63 to the discharge tray 30.

In this way, the plural cooling roller pairs 60 are arranged in the cooling section D so as to provide the film sheet 10 with a desired constant curvature R. This means that the film sheet 10 is transported at the constant curvature R until the sheet is cooled to the glass transition point of the material or less. When the thermal development recording material is intentionally provided with a curvature as described above, the film sheet is not unnecessarily curled before being cooled to the glass transition point of the material or less, and, when the sheet is cooled to the glass transition point or less, a new curl is not formed, and the curl amount is not dispersed.

The temperatures of the cooling rollers themselves and the internal atmosphere of the cooling section D are adjusted. The temperature adjustment equalizes as far as possible the state of the heat processing apparatus immediately after starting up with the state after sufficient running, whereby density variation can be reduced.

Next, the film sheet feeding mechanisms 300 according to the invention will be described in detail.

Figure 2:
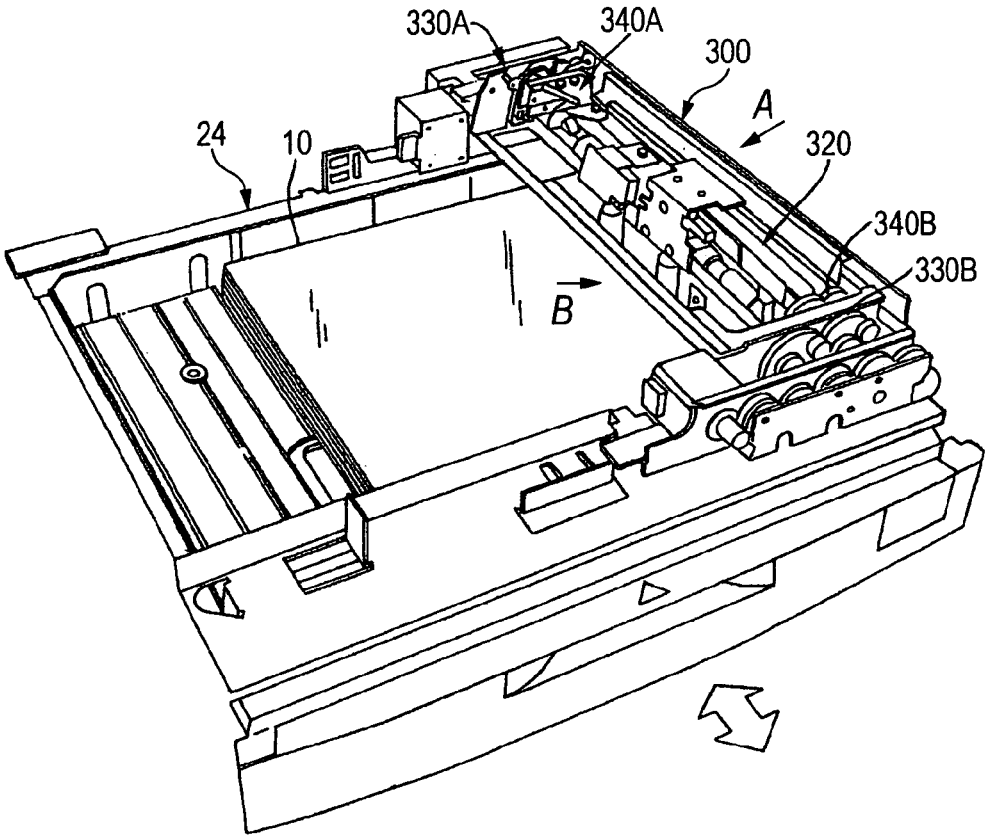
FIG. 2 is an external perspective view showing the film sheet feeding mechanism incorporated in a tray.

FIG. 2 is an external perspective view showing the film sheet feeding mechanisms 300 incorporated respectively in side portions of the trays 24, 26, 28. The film sheet feeding mechanisms 300 incorporated in the side portions of the trays 24, 26, 28 have the same structure, and hence hereinafter the film sheet feeding mechanism 300 for the uppermost tray 24 will be described.

As shown in FIG. 2, the tray 24 is formed into a bottomed box-like shape in which the upper side is opened, and attached to the loading portion (see FIG. 1) 12 so as to be horizontally drawable, via a tray slide mechanism (not shown) on both side faces.

The film sheet feeding mechanism 300 comprises: a feeding arm 320 which is placed above one side portion of the tray 24, and which has film sucking unit (the details are shown in FIG. 3) 310 for taking out the film sheet 10 stacked in the tray 24; arm moving unit 330A, 330B for, while supporting the feeding arm 320, moving the feeding arm 320 between a film taking out position of the tray 24, and a film supplying position on the downstream side in the transportation direction; and lifting and lowering amplification mechanisms 340A, 340B which are disposed in the feeding arm 320, and which lift and lower the film sucking unit 310.

The feeding arm 320 will be described.

Figure 3A:
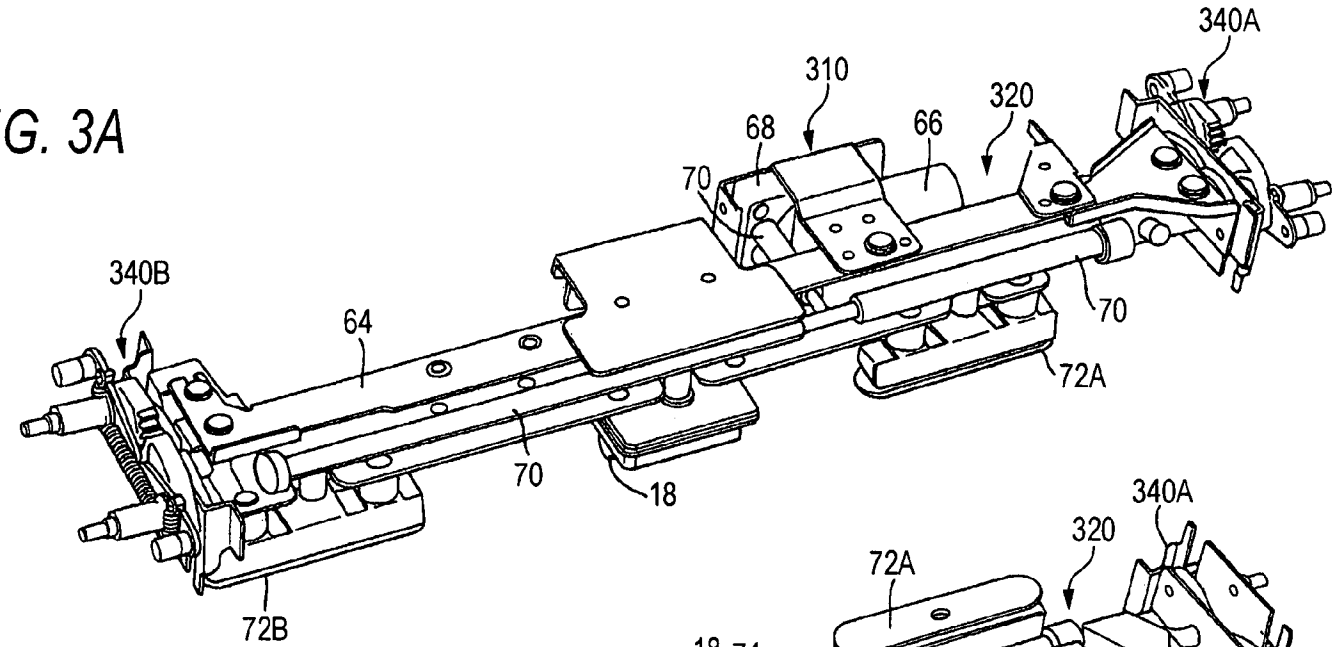
FIG. 3A is an external perspective view of a feeding arm shown in FIG. 2, as viewed in the direction A.
Figure 3B:
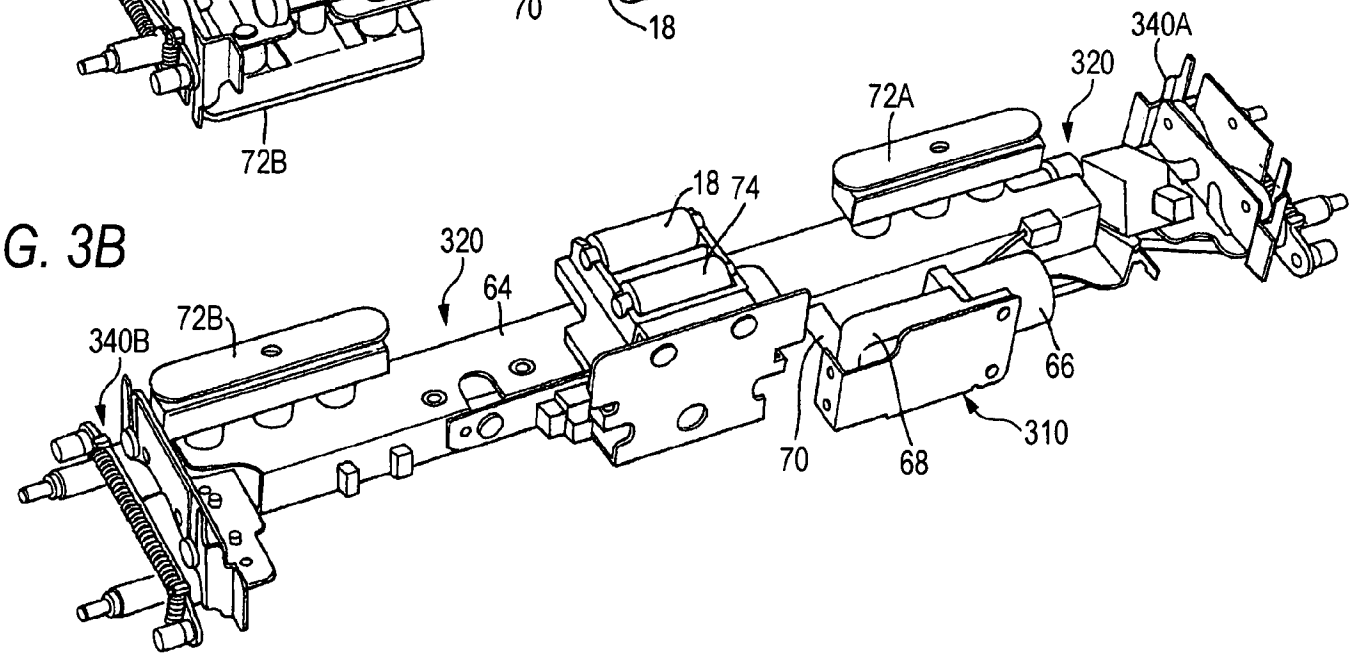
FIG. 3B is an external perspective view of the feeding arm shown in FIG. 3A, as viewed from the rear side.

FIG. 3A is an external perspective view of the feeding arm 320 shown in FIG. 2, as viewed in the direction A, and FIG. 3B is an external perspective view of the feeding arm 320 shown in FIG. 3A, as viewed from the rear side.

As shown in FIG. 3A, the feeding arm 320 has a stay 64 to which the film sucking unit 310 is attached. The film sucking unit 310 is configured by: a motor 66 which is fixed to the stay 64; a pump 68 which is driven by the motor 66 to generate a negative pressure; and a pair of suction disc members 72A, 72B which are communicatingly connected to the pump 68 through a tube 70. The pair of lifting and lowering amplification mechanisms 340A, 340B are attached to the both ends of the stay 64, respectively.

As shown in FIG. 3B, at a middle portion of the stay 64, the upper roller 18 and a transporting roller 74 are rotatably placed with being downward directed. The suction disc members 72A, 72B are formed into an oval shape in which the major axis is in the length direction of the stay 64, and placed on the same line as the position of axis of the upper roller 18 with respect to the movement direction of the feeding arm 320.

When the feeding arm 320 is moved above the film taking out position of the tray 24 by the arm moving unit (see FIG. 2) 330A, 330B, the stay 64 is downward moved in a magnified manner by the lifting and lowering amplification mechanism 340. The film sheet 10 is sucked and held by using the negative pressure which is generated inside the suction disc members 72A, 72B by driving the motor 66. Then, the arm is moved to the film supplying position on the downstream side in the transportation direction by the arm moving unit 330A, 330B, to nip the film sheet 10 held under the upper roller 18, between the upper roller and the lower roller (see FIG. 1) 20, and the film sheet is then transported to the downstream side in the transportation direction.

Next, the arm moving unit 330A, 330B will be described.

Figure 4A:
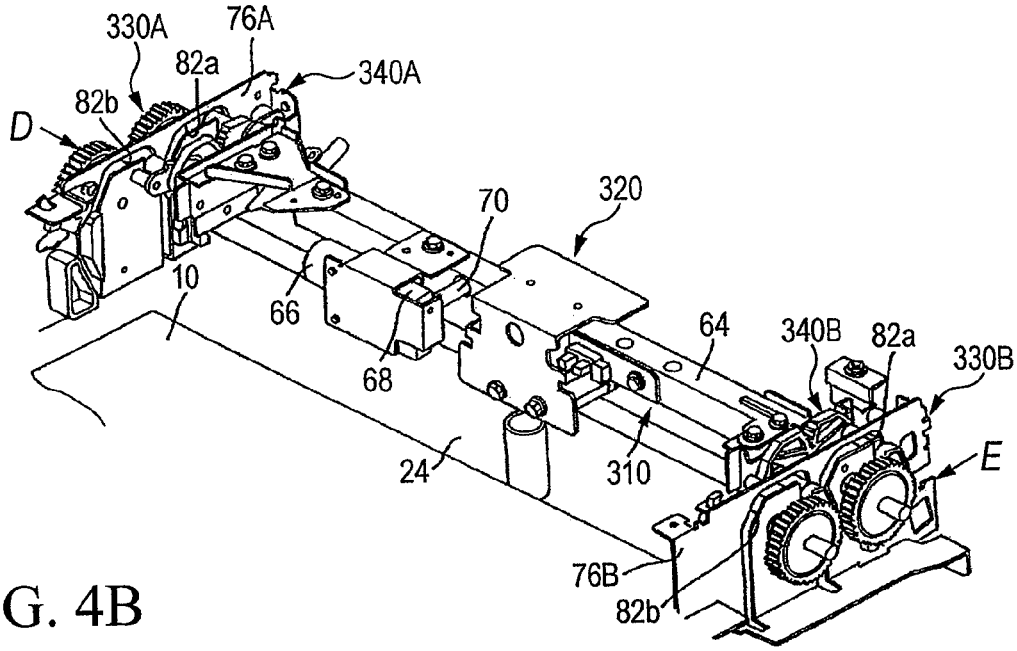
FIG. 4A is an external perspective view of arm moving unit shown in FIG. 2, as viewed in the direction B.
Figure 4B:
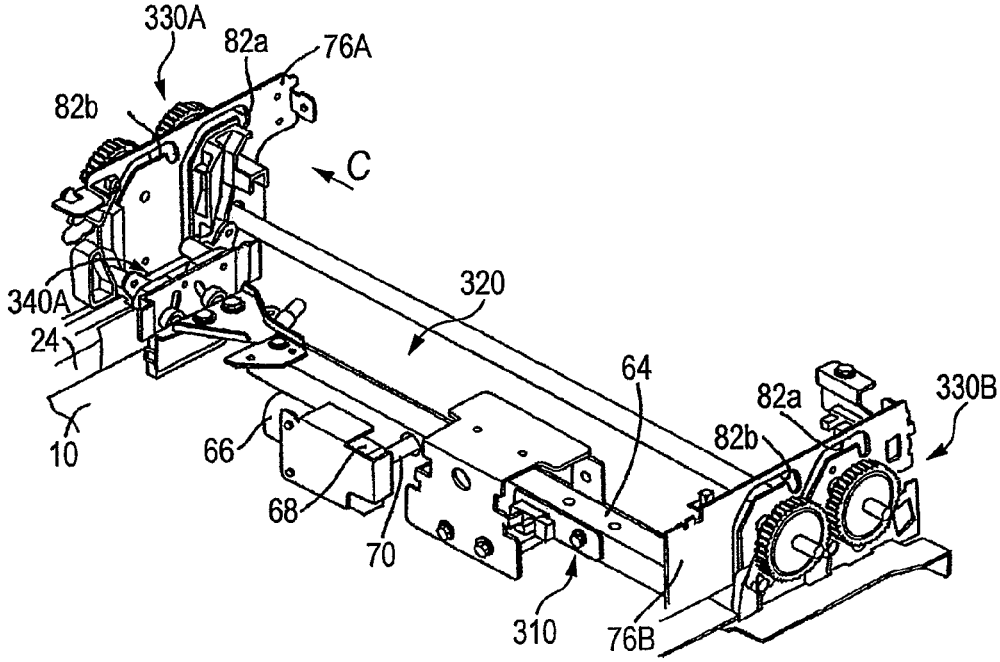
FIG. 4B is an external perspective view of the arm moving unit shown in FIG. 2, at a sucking position as viewed in the direction B.
Figure 5:
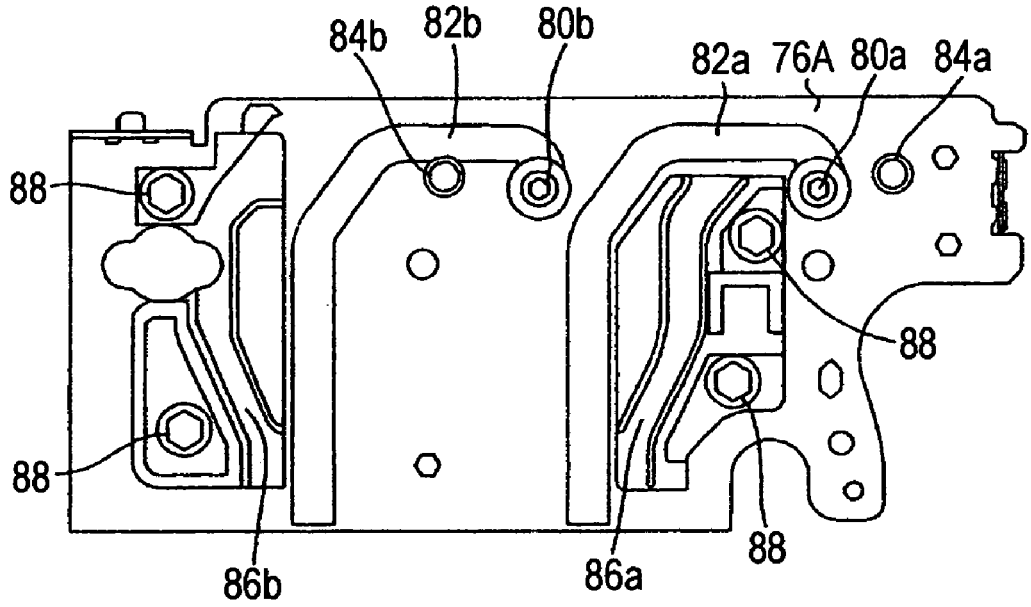
FIG. 5 is a front view of a side plate as viewing the arm moving unit shown in FIG. 4B in the direction C.
Figure 6:
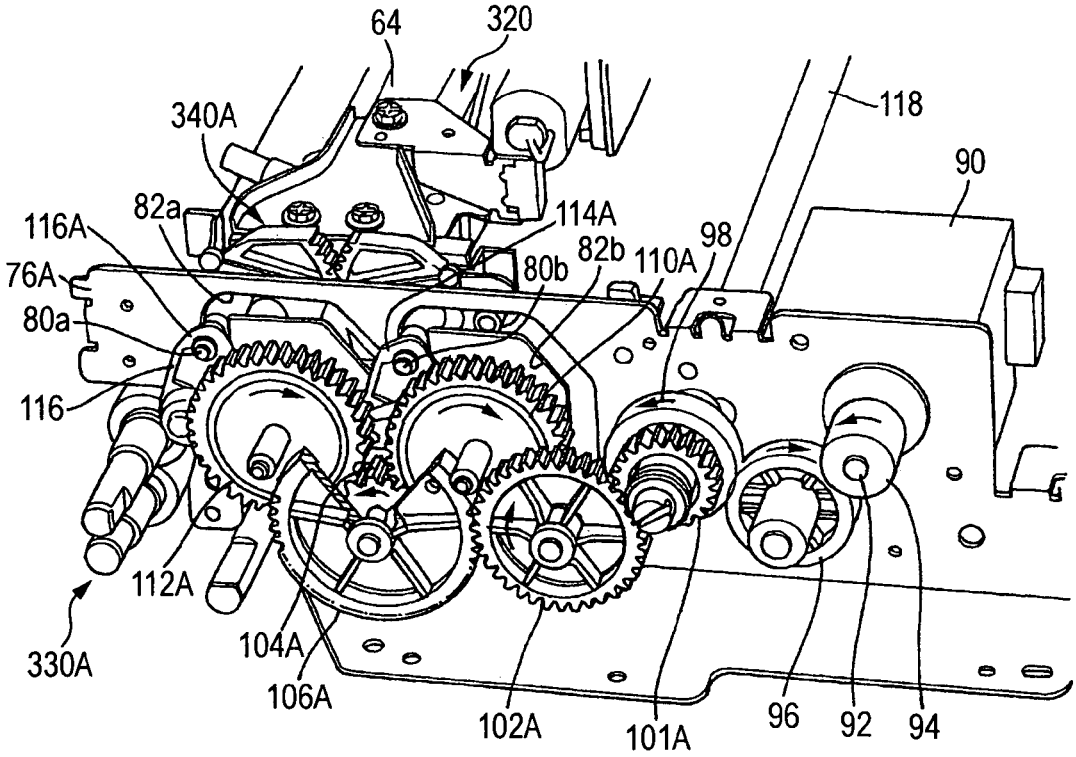
FIG. 6 is an external perspective view of the arm moving unit as viewed in the direction D of FIG. 4A.
Figure 7:
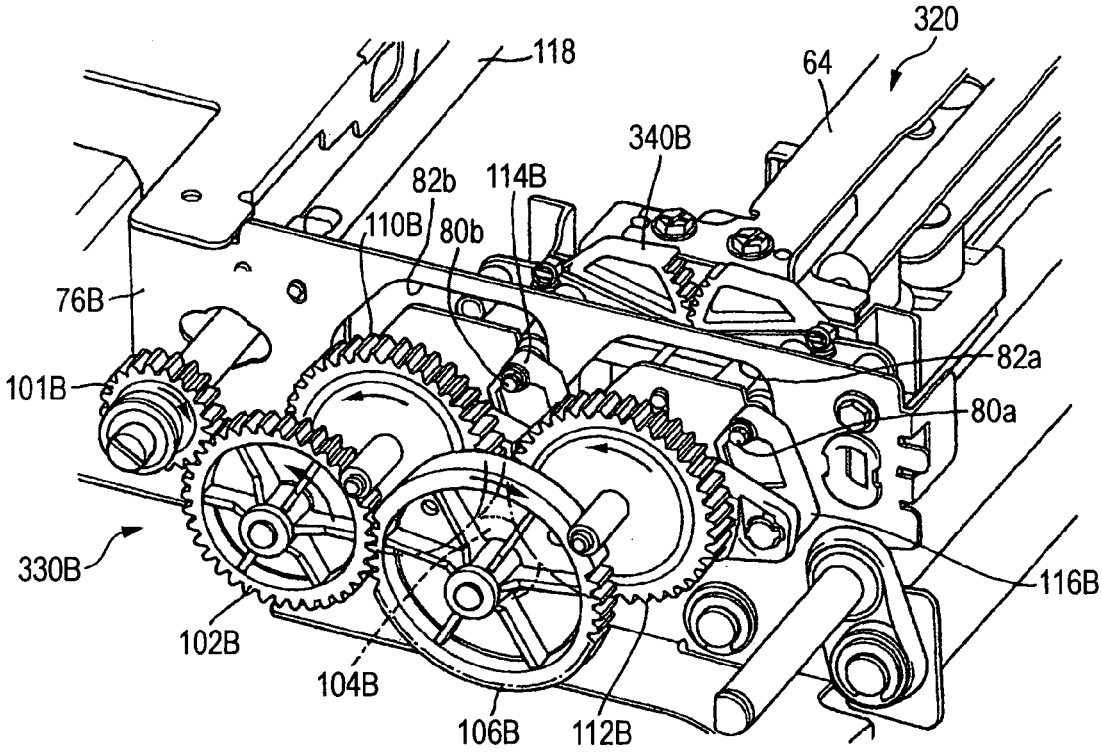
FIG. 7 is an external perspective view of the arm moving unit as viewed in the direction E of FIG. 4A.

FIG. 4A is an external perspective view of the arm moving unit 330 shown in FIG. 2, as viewed in the direction B, FIG. 4B is an external perspective view of the arm moving unit 330 shown in FIG. 2, at the sucking position as viewed in the direction B, FIG. 5 is a front view of a side plate as viewing the arm moving unit 330A shown in FIG. 4B in the direction C, FIG. 6 is an external perspective view of the arm moving unit 330A as viewed in the direction D of FIG. 4A, and FIG. 7 is an external perspective view of the arm moving unit 330B as viewed in the direction E of FIG. 4A.

As shown FIGS. 4A and 4B, the arm moving unit 330A, 330B are supported by a pair of side plates 76A, 76B upstanding from the side portions of the tray 24. The feeding arm 320 is moved by a pair of gear reduction mechanisms placed outside the pair of side plates 76A, 76B.

As shown in FIG. 5, in order to move the feeding arm 320 between the film supplying position and the film taking out position, the inner side of the side plate 76A (the same is applicable also to the side plate 76B) has: a pair of guide holes 82*a*, 82*b* that are L-like holes into which two guide pins 80*a*,

80*b* disposed on the lifting and lowering amplification mechanism 340A (340B) are inserted and guided, respectively; and a pair of cam grooves 86*a*, 86*b* into which two driven cam follower shafts (shown in FIG. 8) disposed on the lifting and lowering amplification mechanism 340A (340B) are housed and guided. Each of the guide holes 82*a*, 82 has a front horizontal portion and a rear vertical portion which elongate along the locus of movement of the feeding arm 320 starting from an initial position of a start end. The cam grooves 86*a*, 86*b* are changed in shape in accordance with the magnified stroke amounts of the lifting and lowering amplification mechanisms 340A, 340B, and detachably attached to the side plates 76A, 76B by bolts 88. In this case, the shapes are set so that the distance between the cam grooves 86*a*, 86*b* is more shortened as advancing further downward.

As shown FIG. 6, a motor 90 is placed inside the side plate 76A. The gear reduction mechanism is configured by: a first pulley 94 which is coupled to a motor shaft 92 of the motor 90; a second pulley 96 which rotates while contacting with the first pulley 94; a third pulley 98 which rotates while contacting with the second pulley 96; a first gear 101A which is coaxially coupled to the third pulley 98; a second gear 102A which meshes with the first gear 101A; a large-diameter gear 106A which meshes with the second gear 102A, and which integrally has a small-diameter gear 104A on the same axis; and fourth and fifth gears 110A, 112A which mesh with the small-diameter gear 104A disposed on the large-diameter gear 106A. One-end portions of link arms 114A, 116A are rotatably connected to outer circumferential portions of the fourth and fifth gears 110A, 112A, respectively. The other end portions of the link arms 114A, 116A are rotatably coupled to the two guide pins 80*a*, 80*b* of the lifting and lowering amplification mechanism 340A via the pair of guide holes 82*a*, 82*b* of the side plate 76A. In FIG. 6, the arm moving unit 330A is positioned at the film taking out position, and therefore the two guide pins 80*a*, 80*b* are placed at the start ends (initial positions) of the pair of guide holes 82*a*, 82*b*, respectively.

In the arm moving unit 330A, when the motor 90 is driven and the motor shaft 92 is rotated in an counterclockwise direction in FIG. 6, the fourth and fifth gears 110A, 112A are rotated in a clockwise direction, and the two guide pins 80*a*, 80*b* are moved from the start ends of the pair of guide holes 82*a*, 82*b* toward the tip ends via the link arms 114A, 116A. By contrast, when the motor shaft 92 is rotated in a clockwise direction in FIG. 6, the fourth and fifth gears 110A, 112A are rotated in a counterclockwise direction, and the two guide pins 80*a*, 80*b* are returned from the tip ends of the pair of guide holes 82*a*, 82*b* toward the start ends via the link arms 114A, 116A.

In the gear reduction mechanism, spur gears may be used in place of the first, second, and third pulleys 94, 96, 98. In order to prevent shocks and vibrations which may be caused in the case where the feeding arm 320 is vertically moved, from being directly applied to the motor shaft 92, the first, second, and third pulleys 94, 96, 98 are preferably configured by using an elastic member such as rubber.

On the other hand, as shown in FIG. 7, the gear reduction mechanism which is on the side opposite to the above-described gear reduction mechanism is configured in a substantially same manner as that shown in FIG. 6. However, the third pulley 98 shown in FIG. 6 is coupled to a first gear 101B in the gear reduction mechanism shown in FIG. 7, via a coupling shaft 118, so that the power of the single motor 90 is supplied uniformly to the pair of gear reduction mechanisms.

Next, the lifting and lowering amplification mechanisms 340A, 340B will be described.

The lifting and lowering amplification mechanism 340A, 340B have the same configuration, and the mechanism 340A will be described as an example.

Figure 8A:
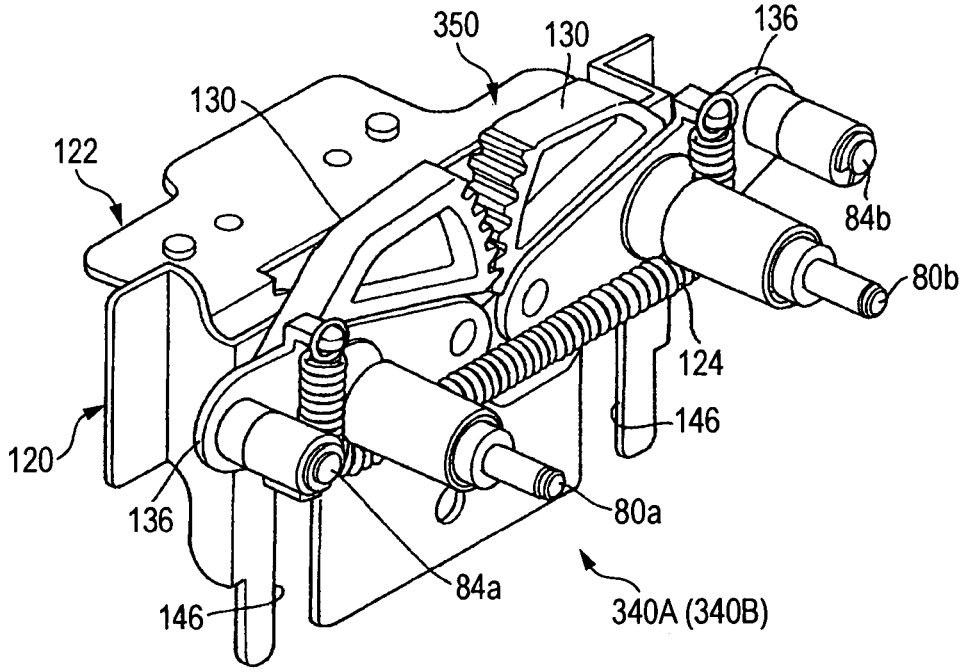
FIGS. 8A and 8B are external perspective views of a lifting and lowering amplification mechanism shown FIG. 3A as viewed in different directions.
Figure 8B:
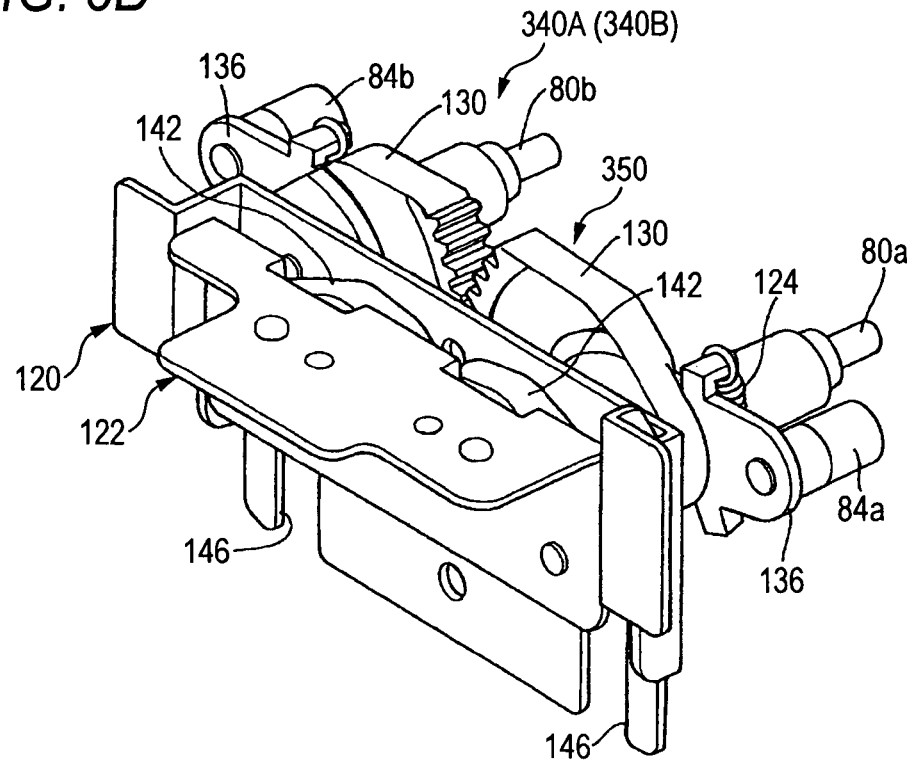
Figure 9:
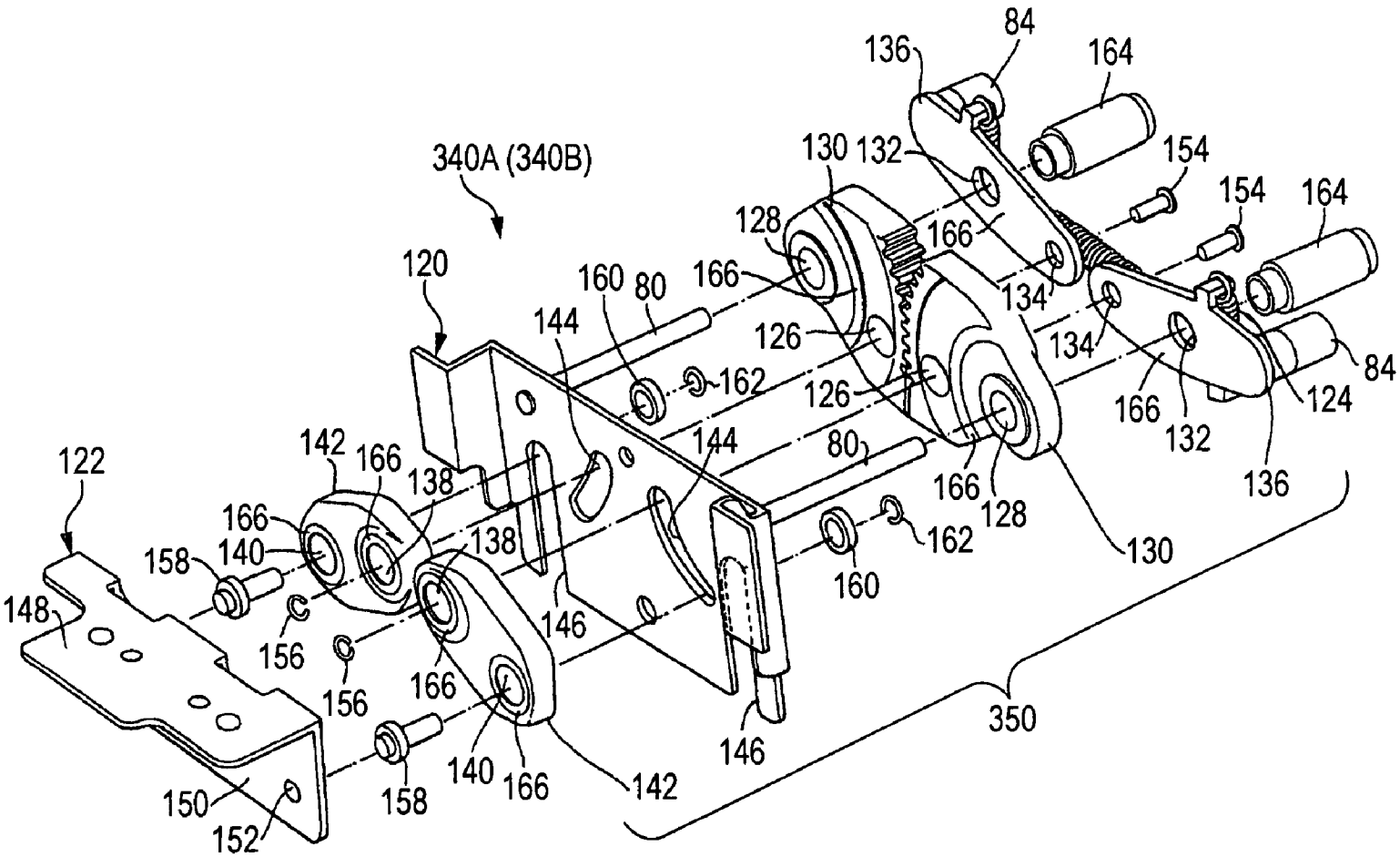
FIG. 9 is an exploded perspective view of the lifting and lowering amplification mechanism.
Figure 10A:
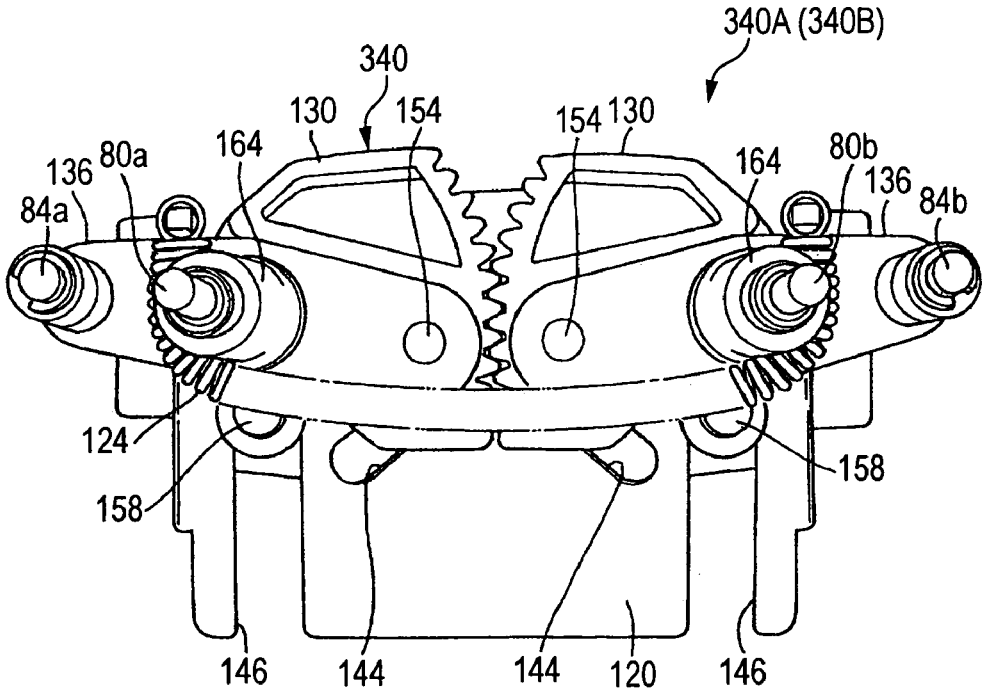
FIG. 10A is a front view of the lifting and lowering amplification mechanism in a return state.
Figure 10B:
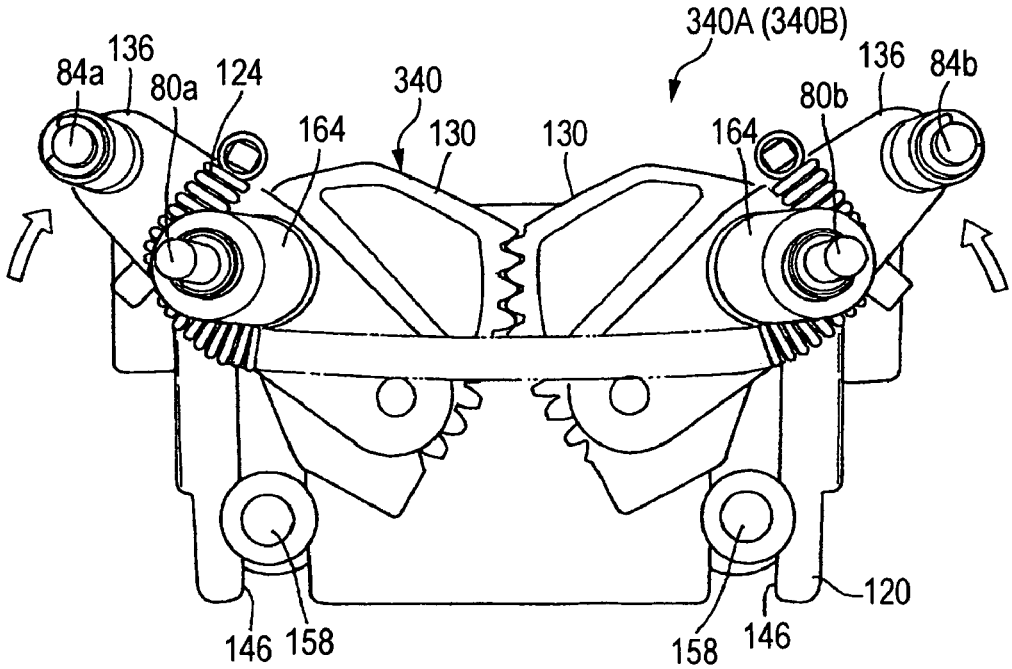
FIG. 10B is a front view of the lifting and lowering amplification mechanism in an operation state.
Figure 11A:
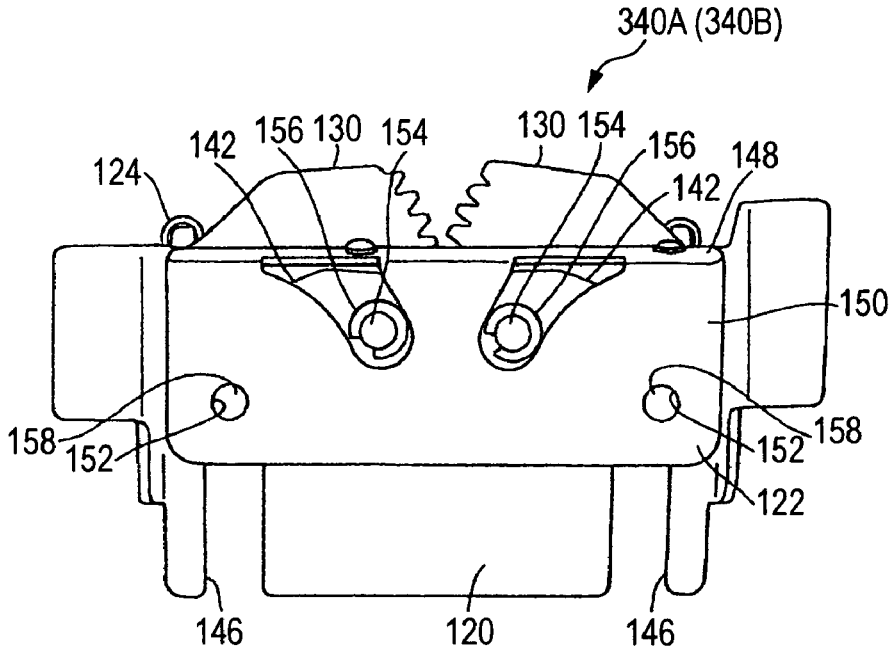
FIG. 11A is a rear view of FIG. 10A.
Figure 11B:
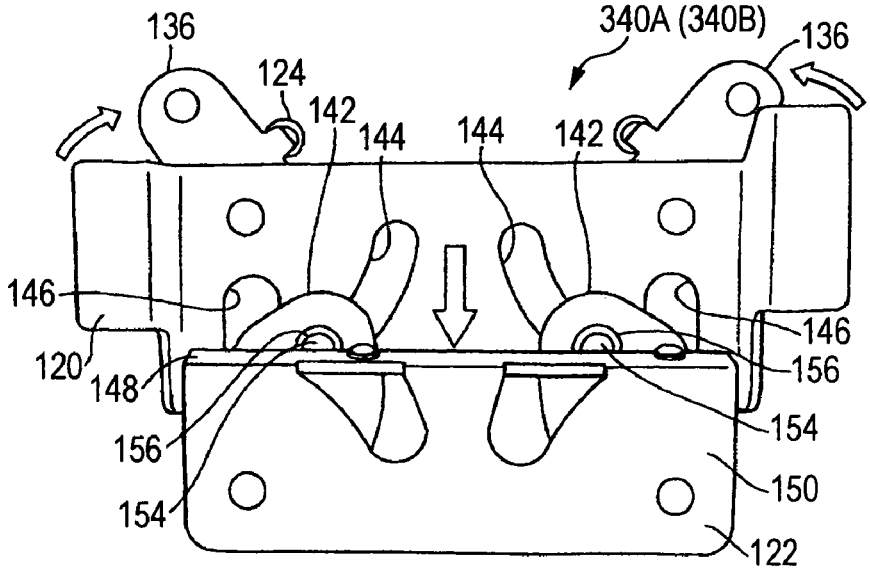
FIG. 11B is a rear view of FIG. 10B.

FIGS. 8A and 8B are external perspective views of the lifting and lowering amplification mechanism shown FIG. 3A as viewed in different directions, FIG. 9 is an exploded perspective view of the lifting and lowering amplification mechanism , FIG. 10A is a front view of the lifting and lowering amplification mechanism in a return state, FIG. 10B is a front view of the lifting and lowering amplification mechanism 340 in an operation state, FIG. 11A is a rear view of FIG. 10A, and FIG. 11B is a rear view of FIG. 10B.

As shown in FIGS. 8A and 8B, the lifting and lowering amplification mechanism 340A (340B) is configured by a stationary plate 120, a lifting and lowing plate 122, the two guide pins 80*a*, 80*b*, two driven cam follower shafts 84*a*, 84*b*, a tension spring 124, and a link mechanism 350.

As shown in FIG. 9, the link mechanism 350 is configured by: one set of sector gears 130, 130 in each of which a connecting shaft hole 126 is formed in an inward end portion, and an insertion hole 128 is formed in an outward end portion; a pair of driven arms 136, 136 in each of which a guide pin hole 132 is formed in a substantially middle portion, the driven cam follower shaft 84*a* or 84*b* is placed in an outward end portion, and a sector gear fixing hole 134 is formed in an inward end portion; and a pair of lifting arms 142, 142 in each of which a sector gear connecting hole 138 is formed in an inward end portion, and a lifting-side plate connecting hole 140 is formed in an outward end portion.

The stationary plate 120 is a plate member which is bent in side portions. The two guide pins 80*a*, 80*b* erect on one face of the plate. A pair of first supporting holes 144, 144 which have an inverted truncated V-shape, and the distance between which is more increased as advancing further downward are formed in a middle portion. A pair of second supporting holes 146, 146 which are opened in a lower side, and which are longitudinally cut away are formed in the vicinities of the sides.

The lifting and lowing plate 122 is a plate member which is bent into an L-like shape, and in which a horizontal plate portion 148 is screwed to the stay 64 of the feeding arm 320, and a pair of pin holes 152 are formed in lower side areas of a vertical portion 150.

In the lifting and lowering amplification mechanism 340A, the guide pins 80*a*, 80*b* of the stationary plate 120 are passed through the insertion holes 128 of the sector gears 130, and further passed through the guide pin holes 132 of the driven arms 136 outside the sector gears 130. Rivets 154 passed through the sector gear fixing holes 134 of the driven arms 136 are passed through the connecting shaft holes 126 of the sector gears 130, and the first supporting holes 144 of the stationary plate 120, and further passed through the sector gear connecting holes 138 of the lifting arms 142. Snap rings 156 are fitted to the rivets. Pivot shafts 158 fixed to the pin holes 152 of the lifting and lowing plate 122 are passed through the lifting-side plate connecting holes 140 of the lifting arms 142, and through the second supporting holes 146 of the stationary plate 120, and then snap rings 162 are fitted via rings 160 to the pivot shafts on the side of the sector gears 130 with respect to the stationary plate 120.

The tension spring 124 is wound around outer peripheral portions of a pair of cylindrical members 164 placed on the driven arms 136 respectively having the guide pin hole 132. The tension spring 124 urges the guide pins 80*a*, 80*b* via the cylindrical members 164, and therefore the driven cam follower shafts 84*a*, 84*b* are held to respective predetermined initial positions by the elastic force accumulated in the tension spring 124. Since the tension spring 124 is simply wound around the guide pins 80*a*, 80*b*, the tension spring does not protrude to the outside, and the holding forces to the guide pins 80*a*, 80*b* can be uniformly applied.

In the lifting and lowering amplification mechanism 340A, contact faces 166 where opposing members are in contact with each other are formed respectively between the pair of sector gears 130, 130 and the stationary plate 120, between the pair of sector gears 130, 130 and the pair of driven arms 136, 136, between the pair of lifting arms 142, 142 and the stationary plate 120, and between the lifting arms 142, 142 and the lifting and lowing plate 122. This configuration is employed in order that a large bending moment which is produced when the film sucking unit 310 conducts the lifting/lowering operation is dispersively received by the components of the link mechanism 350.

As shown in FIGS. 10A and 11A, in the lifting and lowering amplification mechanism 340A, when the two guide pins 80*a*, 80*b* are moved with being guided from the start ends of the pair of guide holes (see FIG. 7) 82*a*, 82*b* of the side plate (see FIG. 5) 76A toward the tip end, the distance between the two driven cam follower shafts 84*a*, 84*b* is increased, and the lifting and lowing plate 122 is positioned at the uppermost position.

As shown in FIGS. 10B and 11B, in the lifting and lowering amplification mechanism 340A, when the two guide pins 80*a*, 80*b* are continued to be moved from the start ends of the pair of guide holes 82*a*, 82*b* of the side plate (see FIG. 5) 76A toward the tip ends, the two driven cam follower shafts 84*a*, 84*b* begin to be guided by the pair of cam grooves 86*a*, 86*b*. Since the distance between the cam grooves 86*a*, 86*b* is more shortened as advancing further downward, the distance between the two driven cam follower shafts 84*a*, 84*b* is decreased. When the distance between the two driven cam follower shafts 84*a*, 84*b* is decreased, the driven arms 136, 136 are swung while being supported by the guide pins 80*a*, 80*b*, and the sector gears 130, 130 are swung in accordance with the swing operations of the driven arms 136, 136. When the sector gears 130, 130 are swung, the rivets 154 passed through the connecting shaft holes 126 of the sector gears 130 are downward displaced along the first supporting holes 144 of the stationary plate 120. In accordance with the downward displacement of the rivets 154, 154, the pivot shafts 158 passed through the lifting-side plate connecting holes 140 of the lifting arms 142, 142 are downward displaced while being supported in the second supporting holes 146, and the lifting arms 142, 142 are swung. As a result, the lifting and lowing plate 122 is moved from the uppermost position to the lowermost position while maintaining the horizontal posture.

In the lifting and lowering amplification mechanism 340A, when the two guide pins 80*a*, 80*b* are thereafter returned from the tip ends of the pair of guide holes 82*a*, 82*b* of the side plate 76A toward the start ends, the two driven cam follower shafts 84*a*, 84*b* are not guided by the pair of cam grooves 86*a*, 86*b* of the side plate 76A, and the distance between the shafts is increased. As a result, the link mechanism 350 is swung in the opposite direction, and therefore the lifting and lowing plate 122 is positioned at the uppermost position. In this way, the lifting and lowing plate 122 is moved from the uppermost position to the lowermost position while maintaining the horizontal posture, whereby the film sucking unit (see FIG. 4) 310 is downward moved in a magnified manner at the film taking out position to conduct the operation of sucking the film sheet 10. At this time, during the stroke of lifting and lowering the film sucking unit 310 via the link mechanism 350, the coupling of the guide pins 80*a*, 80*b* and the driven cam follower shafts 84*a*, 84*b* is realized via the meshing of the sector gears 130. Consequently, there is no deviation in rotation between the guide pins 80*a*, 80*b* and the driven cam follower shafts 84*a*, 84*b*, and the film sucking unit 310 can be moved in parallel in a stabilized posture.

In the lifting and lowering amplification mechanism 340A, the guide pins 80*a*, 80*b* are moved along the pair of guide holes 82*a*, 82*b*, whereby the operations of lifting and lowering the film sucking unit 310 can be conducted via the link mechanism 350. Therefore, a driving source for lifting and lowering the film sucking unit 310 is not required, and the structure can be simplified. When the guide pins 80*a*, 80*b* are moved along the pair of guide holes 82*a*, 82*b*, the driven cam follower shafts 84*a*, 84*b* are housed in the pair of cam grooves 86*a*, 86*b*. As the feeding arm 320 is further lowered, the distance between the driven cam follower shafts 84*a*, 84*b* is more decreased in accordance with the amount of change in distance between the cam grooves 86*a*, 86*b*, thereby magnifying the lifting/lowering distance of the film sucking unit 310. In this way, the distance between the driven cam follower shafts 84*a*, 84*b* can be changed by increasing or decreasing the distance between the pair of cam grooves 86*a*, 86*b*. With using this distance change, the lifting/lowering distance of the film sucking unit 310 can be easily set by the link mechanism 350.

The operation of the above-described configuration of the film sheet feeding mechanism 300 will be described.

Figure 12A:
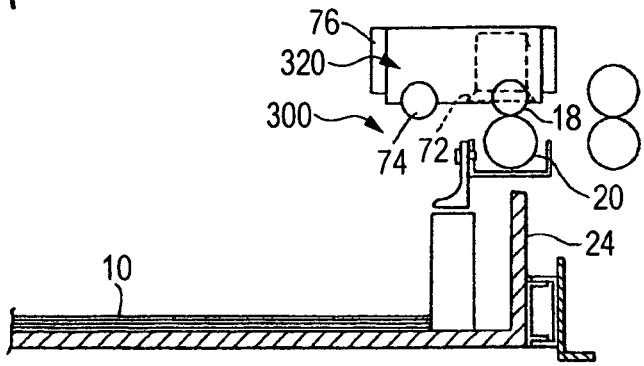
FIG. 12A is a diagram illustrating the operation of a film sheet feeding mechanism and showing a film supplying position.
Figure 12B:
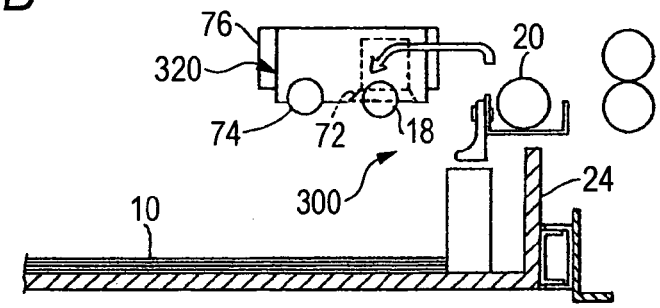
FIG. 12B is a diagram showing a position at which the operation is started from the film supplying position.
Figure 12C:
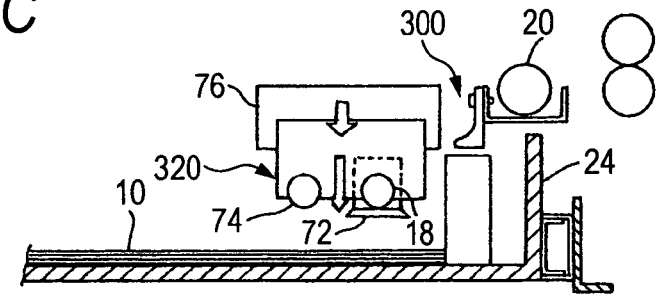
FIG. 12C is a diagram showing a position at which the mechanism is close to a film taking out position.
Figure 12D:
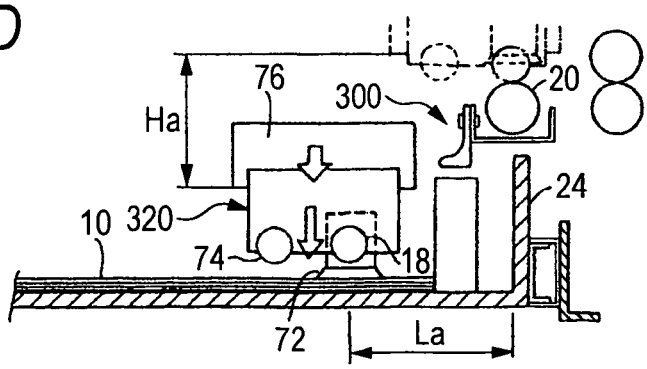
FIG. 12D is a diagram showing the film taking out position.
Figure 13:
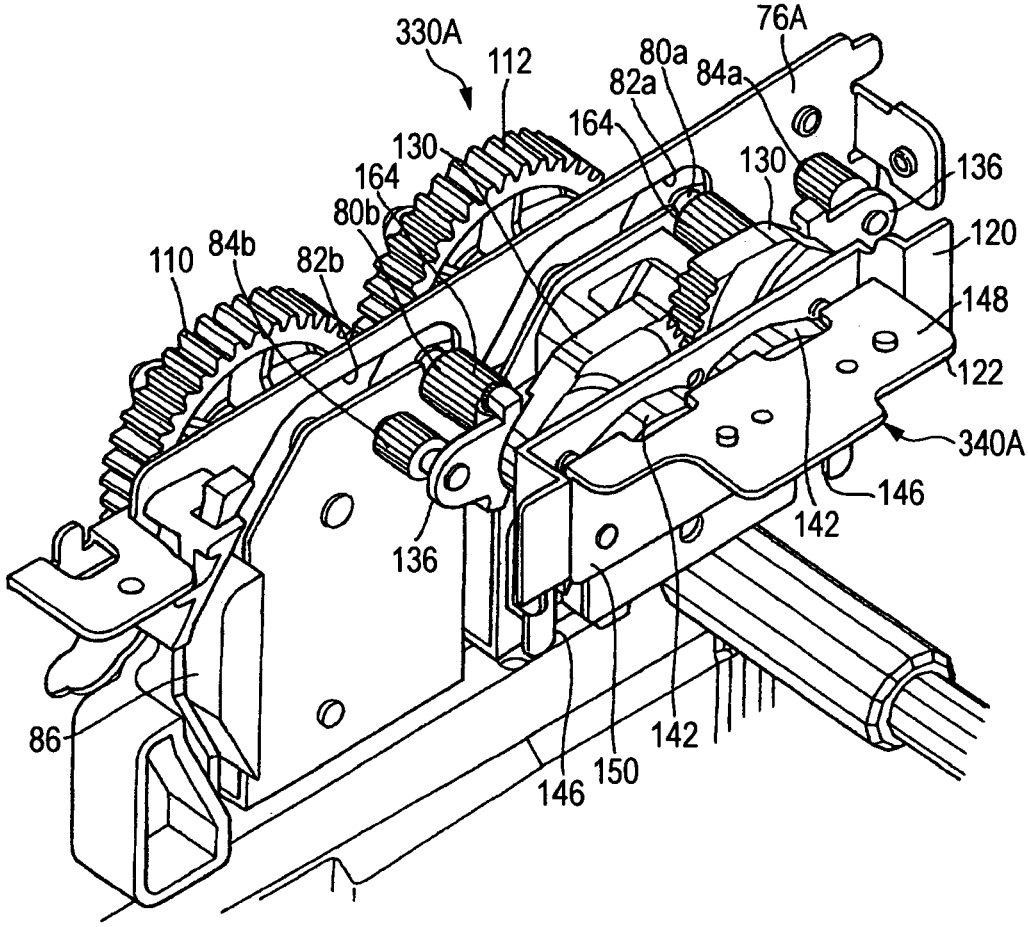
FIG. 13 is an external perspective view of the arm moving unit at the position of FIG. 12A.
Figure 14:
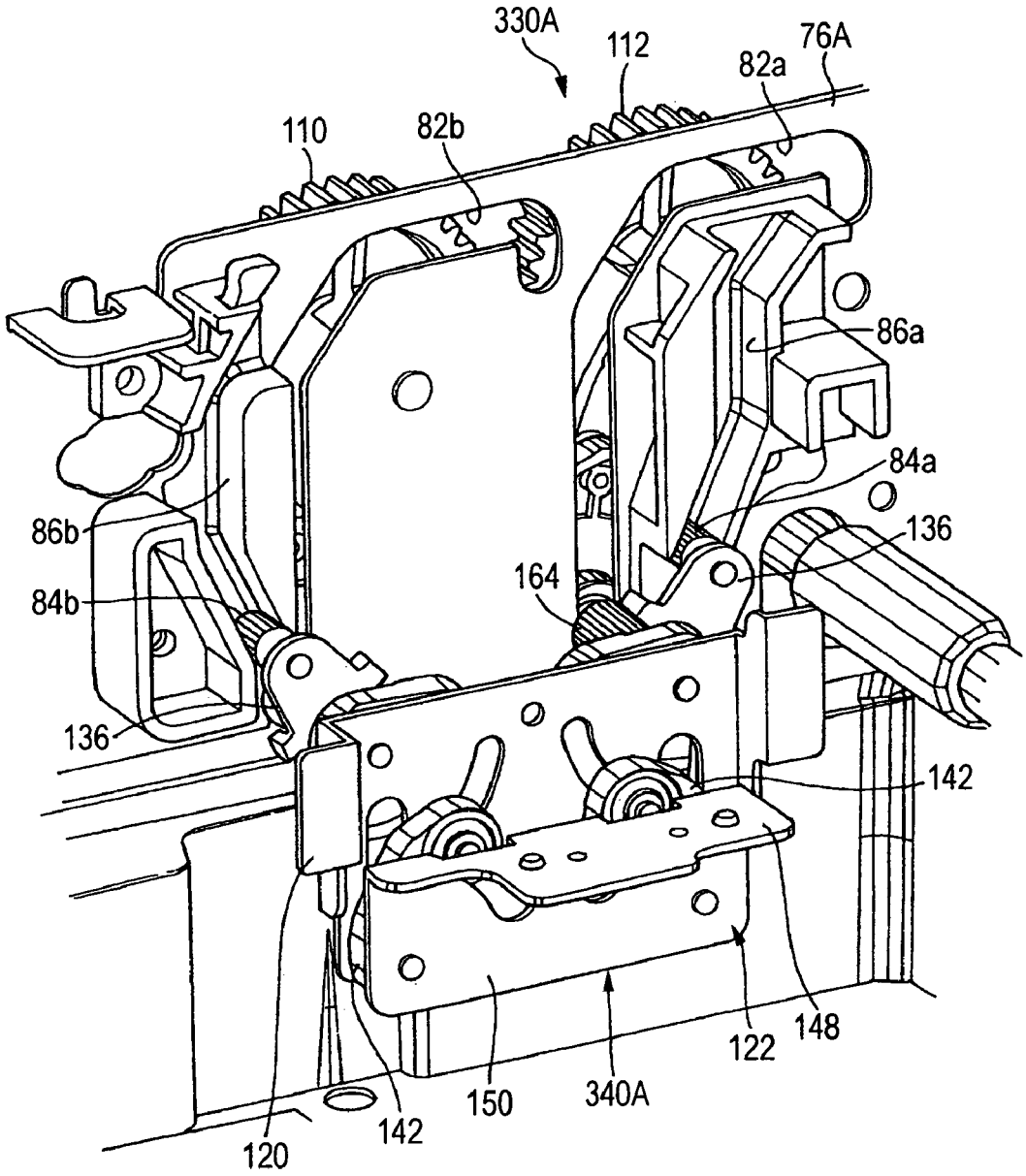
FIG. 14 is an external perspective view of the arm moving unit at the position of FIG. 12D.
Figure 15:
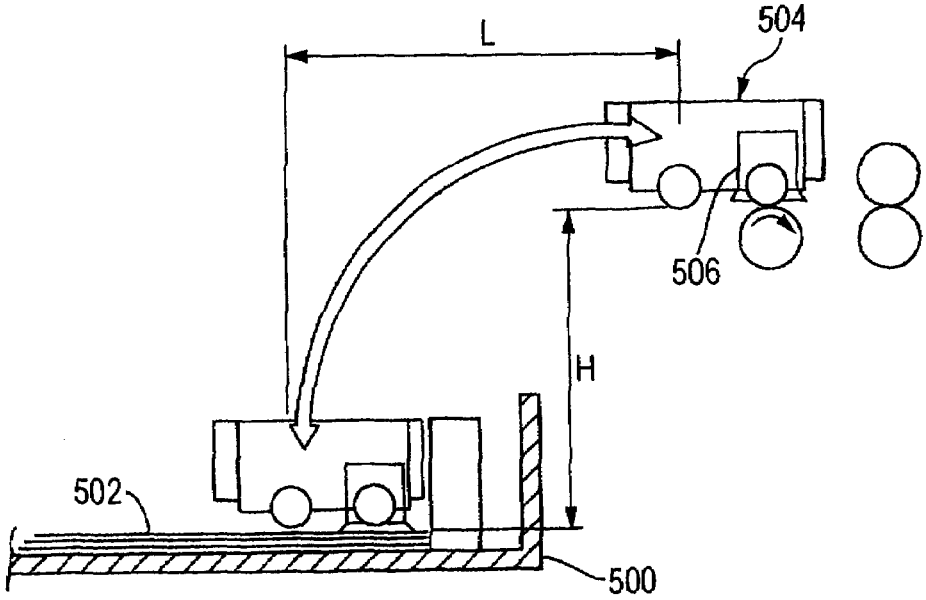
PRIOR ART FIG. 15
FIG. 15 is a diagram of a conventional film sheet feeding mechanism.

FIG. 12A is a diagram illustrating the operation of the film sheet feeding mechanism and showing the film supplying position, FIG. 12B is a diagram showing a position at which the operation is started from the film supplying position, FIG. 12C is a diagram showing a position at which the mechanism is close to the film taking out position, FIG. 12D is a diagram showing the film taking out position, FIG. 13 is an external perspective view of the arm moving unit at the position of FIG. 12A, and FIG. 14 is an external perspective view of the arm moving unit at the position of FIG. 12D.

As shown in FIG. 12A, at the film supplying position which is the initial position, the feeding arm 320 is positioned in one side portion of the tray 24, and the upper roller 18 is opposed to the lower roller 20. At this time, as shown FIG. 13, the guide pins 80*a*, 80*b* are positioned at the starting ends of the pair of guide holes 82*a*, 82*b* of the side plate 76A (the same is applicable also to the side plate 76B), and therefore the distance between the driven cam follower shafts 84*a*, 84*b* is increased, so that the lifting and lowing plate 122 to which the feeding arm 320 is attached is positioned at the uppermost position. Namely, the feeding arm 320 is placed at the uppermost position.

When the feeding arm 320 is moved by driving the arm moving unit 330A, 330B as shown in FIG. 12B, the guide pins 80*a*, 80*b* are separated from the starting ends of the guide holes 82*a*, 82*b* (see FIG. 5), and laterally moved in the horizontal portions of the guide holes 82*a*, 82*b*. At this time, the distance between the driven cam follower shafts 84*a*, 84*b* remains to be increased.

When the arm moving unit 330 is continued to be driven and then transferred to vertical movement as shown in FIG. 12C, the guide pins 80*a*, 80*b* are transferred to the vertical portions of the guide holes 82*a*, 82*b* (see FIG. 5), and the feeding arm 320 begins to be lowered. At this time also, the distance between the driven cam follower shafts 84*a*, 84*b* remains to be increased.

When the feeding arm 320 is lowered by driving the arm moving unit 330A as shown in FIG. 12D, the guide pins 80*a*, 80*b* are lowered along the vertical portions of the guide holes

82*a*, 82*b*, and then the driven cam follower shafts 84*a*, 84*b* are guided by the cam grooves 86*a*, 86*b* to shorten the distance therebetween. At this time, as shown FIG. 14, the guide pins 80*a*, 80*b* are positioned at the tip ends of the pair of guide holes 82*a*, 82*b* of the side plate 76A (the same is applicable also to the side plate 76B ), and the distance between the driven cam follower shafts 84*a*, 84*b* is decreased. Therefore, the lifting and lowing plate 122 to which the feeding arm 320 is attached is positioned at the lowermost position. Namely, the movement of the feeding arm 320 to the lowermost position is magnified, and the feeding arm is placed at the lowermost position.

As described above, the film sheet feeding mechanism 300 is moved by a horizontal stroke amount La which is a lateral moving distance from the side portion of the tray 24, and a vertical stroke amount Ha which is a lowering distance from the above of the tray 24. In a state where the feeding arm 320 is at the film taking out position, the film sucking unit 310 conducts the lifting/lowering operation in which the lowering distances of the guide pins 80*a*, 80*b* are magnified, whereby the feeding arm 320 of a short stroke can be configured. Furthermore, the feeding arm 320 and the lifting and lowering amplification mechanism 340 can be placed inside the tray 24. While suppressing the movement stroke by the arm moving unit 330A, 330B to a short one, therefore, the lifting and lowering amplification mechanism 340 can bear the vertical movement of the feeding arm 320. Consequently, a low-profile structure using a small-sized unit configuration can be realized, and the whole apparatus can be reduced in size. When the thus configured film sheet feeding mechanism 300 is used as a mechanism for supplying the film sheets 10 to the image exposing section (see FIG. 1) B, it is possible to reduce the size of the thermal development recording apparatus 100.

As described above, in the film sheet feeding mechanism 300 of the invention, when the feeding arm 320 is moved by the arm moving unit 330A, 330B between the film taking out position of the tray 24, and the film supplying position on the downstream side in the transportation direction, the film sucking unit 310 conducts the magnified lifting/lowering operation at the film taking out position by means of the lifting and lowering amplification mechanism 340A, 340B. Therefore, the film sucking unit 310 conducts the magnified vertical operation in the state where the feeding arm 320 is at the film taking out position, whereby the stroke of the feeding arm 320 can be shortened as compared with a conventional one. The lifting and lowering amplification mechanism can be placed inside the tray 24. Therefore, the film sheet feeding mechanism can be configured by a small unit, and reduced in thickness, thereby realizing a small size.

In the film sheet feeding mechanism 300, the guide pins 80*a*, 80*b* are moved along the guide holes 82*a*, 82*b* of the arm moving unit 330, thereby causing the lifting and lowering amplification mechanism 340A, 340B to lift and lower the film sucking unit 310 via the link mechanism 350. Therefore, a driving source for lifting and lowering the film sucking unit 310 is not necessary, and the structure of the mechanism is simplified.

In the film sheet feeding mechanism 300, during the movement stroke of lifting and lowering the film sucking unit 310 via the link mechanism 350, the coupling of the guide pins 80*a*, 80*b* and the driven cam follower shafts 84*a*, 84*b* is realized via the meshing of the sector gears 130, 130. Consequently, there is no deviation in rotation between the guide pins 80*a*, 80*b* and the driven cam follower shafts 84*a*, 84*b*, and the film sucking unit 310 can be moved in parallel in a stabilized posture.

The film sheet feeding mechanism of the invention, and the thermal development recording apparatus having the mechanism are not restricted to the above-described embodiment, and can be adequately modified and improved.

For example, the configuration of the lifting and lowering amplification mechanism is not restricted to the illustrated example. The sector gears and the driven arms are integrally molded with, for example, a resin, or the stationary plate and the lifting and lowing plate are molded with a resin. The film sheet feeding mechanism can be preferably applied not only to a thermal development recording apparatus, but also to another apparatus for feeding sheet-like films.

What is claimed is:

1. A film sheet feeding mechanism for taking out one by one an uppermost film sheet from a tray on which plural film sheets in a cut-sheet state are stacked, and feeding the film sheet toward a downstream side in a direction of transporting the film sheet, wherein the mechanism comprises:

a feeding arm having a film sucking unit for taking out the film sheet in the tray;

an arm moving unit configured to support the feeding arm and move the feeding arm in a direction parallel to a surface of the film sheets between a film taking out position of the tray wherein the film sheet is taken out of the tray and a film supplying position located downstream of the film taking out position; and a lifting and lowering amplification mechanism disposed on the feeding arm which lowers the film sucking unit away from the feeding arm toward the film sheet when moving toward the film taking out position of the tray.

2. The film sheet feeding mechanism according to claim 1, wherein the arm moving unit comprises side plates on sides of both ends of the feeding arm, each of the side plates having guide paths which are formed along a movement path of the feeding arm, and the lifting and lowering amplification mechanism has guide pins which are inserted into the guide paths, and lifts and lowers the film sucking unit via a link mechanism which moves the guide pins along the guide paths.

3. The film sheet feeding mechanism according to claim 2, wherein the lifting and lowering amplification mechanism comprises: two driven cam follower shafts which follow movements of the guide pins along the guide paths; and a link mechanism which lifts and lowers the film sucking unit by means of movements of the cam follower shafts, the arm moving unit comprises two cam grooves in each of the side plates, the cam grooves housing and guiding cam followers of the two driven cam follower shafts, and as the feeding arm is lowered, a distance between the two cam grooves of each of the side plates is increased, and a lifting and lowering distance of the film sucking unit is increased by the link mechanism.

4. The film sheet feeding mechanism according to claim 3, wherein, in a part of the link mechanism, meshing of sector gears is interposed for a whole stroke of the lifting and lowering operation.

5. The film sheet feeding mechanism according to claim 3, wherein a tension spring which maintains the driven cam follower shafts to an initial position is wound around the guide pins.

6. The film sheet feeding mechanism according to claim 3, wherein link components constituting the link mechanism are in contact via contacting faces of counter link components connected to the link components in portions of the link components corresponding to a fulcrum and a point of application.

7. A thermal development recording apparatus comprising at least:

an exposing section that exposes a thermal development recording material configured by one of a thermal development photosensitive material and a photosensitive heat sensitive recording material, to form a latent image; and a thermal developing section that heats the thermal development recording material having thereon the latent image to conduct thermal development, wherein a mechanism that supplies the thermal development recording material to the exposing section is a film sheet feeding mechanism according to claim 1.

8. The thermal development recording apparatus according to claim 7, wherein the arm moving unit comprises side plates respectively on sides of both ends of the feeding arm, each of the side plates having guide paths which are formed along a movement path of the feeding arm, and the lifting and lowering amplification mechanism has guide pins which are inserted into the guide paths, and lifts and lowers the film sucking unit via a link mechanism which moves the guide pins along the guide paths.

9. The thermal development recording apparatus according to claim 8, wherein the lifting and lowering amplification mechanism comprises: two driven cam follower shafts which follow the movements of the guide pins along the guide paths; and a link mechanism which lifts and lowers the film sucking unit by means of movements of the cam follower shafts, the arm moving unit comprises two cam grooves in each of the side plates, the cam grooves housing and guiding cam followers of the two driven cam follower shafts, and as the feeding arm is lowered, a distance between the two cam grooves of each of the side plates is increased, and a lifting and lowering distance of the film sucking unit is increased by the link mechanism.

10. The thermal development recording apparatus according to claim 9, wherein, in a part of the link mechanism, meshing of sector gears is interposed for a whole stroke of the lifting and lowering operation.

11. The thermal development recording apparatus according to claim 9, wherein a tension spring which maintains the driven cam follower shafts to an initial position is wound around the guide pins.

12. The thermal development recording apparatus according to claim 9, wherein link components constituting the link mechanism are in contact via contacting faces of counter link components connected to the link components in portions of the link components corresponding to a fulcrum and a point of application.

13. The thermal development apparatus according to claim 1, wherein the lifting and lowering amplification mechanism lifts the film sucking unit toward the feeding arm away from the film sheet when moving away from the film taking out position of the tray.

* * * * *